United States Patent [19]

Agostinelli et al.

[11] Patent Number: 4,976,877

[45] Date of Patent: Dec. 11, 1990

[54] CERAMIC CUPRIC OXIDE COATED PRESSURE ROLL FOR IMAGE FIXING

[75] Inventors: John A. Agostinelli, Rochester; William J. Staudenmayer, Pittsford, both of N.Y.

[73] Assignee: Eastman Kodak Company, Rochester, N.Y.

[21] Appl. No.: 408,180

[22] Filed: Sep. 15, 1989

[51] Int. Cl.[5] ..... G03G 15/20

[52] U.S. Cl. ..... 219/216; 355/290

[58] Field of Search ..... 219/216, 469, 388; 355/290, 284

[56] References Cited

U.S. PATENT DOCUMENTS

| | | | |
|---|---|---|---|
| 2,482,021 | 9/1949 | Mickelson . | |
| 2,545,792 | 3/1951 | Perrault . | |
| 3,117,028 | 1/1964 | Kaulen . | |
| 3,188,371 | 6/1965 | Weekley . | |
| 3,637,976 | 1/1972 | Ohta . | |
| 3,937,637 | 2/1976 | Moser . | |
| 4,018,953 | 4/1977 | Martellock . | |
| 4,078,285 | 3/1978 | Seanor . | |
| 4,257,699 | 3/1981 | Lentz . | |
| 4,264,181 | 4/1981 | Lentz . | |
| 4,266,115 | 5/1981 | Dannatt . | |
| 4,272,179 | 6/1981 | Seanor | 219/216 |
| 4,438,321 | 3/1984 | Moraw | 219/216 |
| 4,505,418 | 3/1985 | Neidig . | |
| 4,525,387 | 6/1985 | Ebata . | |
| 4,724,305 | 2/1988 | Iimura | 219/469 |
| 4,776,070 | 10/1988 | Shibata . | |

FOREIGN PATENT DOCUMENTS

| | | |
|---|---|---|
| 2449735 | 4/1976 | Fed. Rep. of Germany . |
| 146203 | 4/1980 | Japan . |
| 055290 | 5/1981 | Japan . |
| 002878 | 2/1983 | Japan . |
| 191871 | 2/1986 | Japan . |
| 045192 | 8/1986 | Japan . |

*Primary Examiner*—Teresa J. Walberg

*Attorney, Agent, or Firm*—Dressler, Goldsmith, Shore, Sutker & Milnamow, Ltd.

[57] ABSTRACT

A fuser roll for fusing toner images on a substrate at elevated temperatures is provided that has its circumferential surfaces coated with a ceramic cupric oxide coating that is overcoated with a chemically bound layer of a mercapto-group containing siloxane fluid. The coating is achieved by passing the roll upwardly through a ring coater which applies a solution of cupric carboxylate that is thermally converted to ceramic cupric oxide. The fuser roll displays superior service life even at elevated toner fusing temperatures.

7 Claims, 1 Drawing Sheet

CERAMIC CUPRIC OXIDE COATED PRESSURE ROLL FOR IMAGE FIXING

FIELD OF THE INVENTION

This invention is in the field of pressure rolls for image fixing and processes for making and using the same. This invention can also be regarded as in the field of fuser rolls, since pressure rolls can function as fuser rolls in duplex copying applications.

BACKGROUND OF THE INVENTION

The electrophotographic process requires an image fixing procedure to adhere a toned image to a receiving surface, such as a sheet of paper, or the like. A typical image fixing apparatus comprises a pair of heated fusing and pressure rollers between which the toned receiver passes. The roller surfaces are an important feature since they must be released from the heated toner without adhesion thereto.

Various hot roll fusing devices are shown in the prior art; see, for example U.S. Pat. Nos. 3,637,976; 4,266,115; 4,264,181; and 4,257,699.

However, so far as is now known, no one has heretofore employed ceramic cupric oxide coatings on a fuser roll, or has treated such a coated roll with a mercapto group containing silicone fluid, such as a silicone oil.

SUMMARY OF THE INVENTION

This invention is directed to a ceramic cupric oxide coated, internally heated fuser roll for image fixing.

More particularly, a fuser roll is coated with a ceramic cupric oxide coating, and then overcoated with a mercapto group containing silicone fluid, to produce a bound release layer to which toner does not adhere at toner fusion temperatures.

The resulting hard surface displays selectivity for mercapto group containing silicone fluids, such as mercapto-group containing polysiloxane oils.

When used for toner fixing, the oil treated fuser roll displays long use life even at high fuser roll surface temperatures which might tend to accelerate toner adhesion (offset) thereto.

Advantageously the ceramic cupric oxide coating can be applied to various substrate materials, thereby providing a wide range of thermal properties.

The present invention is also directed to a method of maker fuser rolls comprising the steps of:

(a) coating cylindrical surface, portions of a fuser roll with a solution of cupric carboxylate by moving said fuser roll upwardly through a coating ring which dispenses said solution upon said surface portions;

(b) drying the coating; and (c) heating the coating at a temperature and for a time sufficient to convert said cupric carboxylate to ceramic cupric oxide.

The present invention is further directed to a method of fusing a toner image to a substrate comprising the steps of:

(a) forming a ceramic cupric oxide coating over circumferential surface portions of a fuser roll;

(b) overcoating said coating with a chemically bound layer of a mercapto group containing silicone fluid; and (c) passing said overcoated fuser roll upon and over said toner image on the substrate with said fuser roll being heated to a fusion temperature for said toner powder.

Other and further aims, purposes, features, advantages, embodiments and the like will be apparent to those skilled in the art from the teachings of the present specification and appended drawings taken with the associated claims.

DETAILED DESCRIPTION

Figure 1:
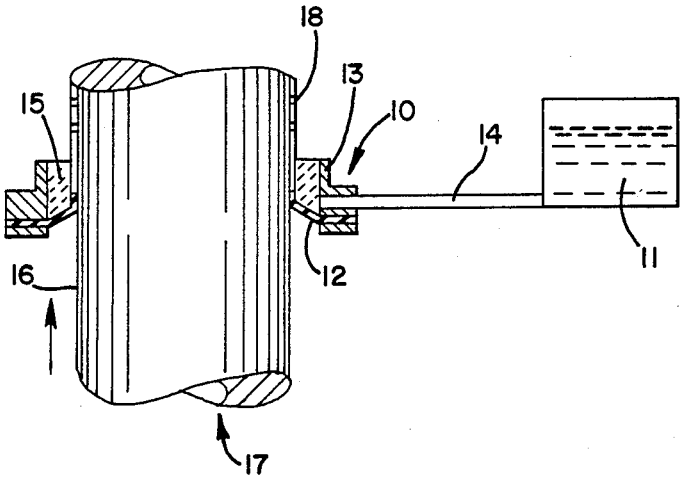
FIG. 1 is a fragmentary view of a roll undergoing ring coating of a copper carboxylate solution in accordance with the present invention in which the ring coating apparatus is shown partially schematically and partially in vertical section.

In general, a fuser roll of this invention is adaptable for use in any electrophotographic copying machine using heated rolls for toner fusing of toned images on sheet material and for operating under conventional copying conditions. Exemplary automatically operating copying machines are described in U.S. Pat. No. 3,937,637, and the like. The operative principles of electrophotography employed in such apparatus are well known. An electrostatic latent image formed on a photoconductive surface is developed by depositing toner powder upon such latent image to produce a toned (developed) image. The image is then transferred from the photoconductive surface by contacting the surface to a sheet member, such as paper, plastic, or the like. The resulting toned image on the sheet member is then passed over a heated fuser roll to fuse the toner powder and create a durable image on the sheet member.

In accordance with the present invention, the circumferential surface positions of the fuser roll which contact the toner and cause the toner to fuse to the substrate upon which the toner is to be affixed are comprised of ceramic cupric oxide (CuO) which has been coated with a chemically bonded silicone release agent. The release agent has incorporated into its structure at least one mercapto group per molecule, and is preferably a relatively high molecular weight silicone oil, such as a mercapto group containing polysiloxane oil. The release agent is chemically bound by reaction of the mercapto groups with the cupric oxide.

The silicone treated ceramic cupric oxide coated fuser rolls of this invention are believed to be superior to conventional fuser rolls having circumferential surfaces wherein copper oxide particles are distributed in an elastomeric matrix because the fuser rolls of this invention appear to display better toner release capabilities and longer service life than such conventional fuser rolls.

In general, any preformed fuser roll assembly having relatively hard circumferential roll surfaces known in the prior art can be used as a starting structure for the preparation of a ceramic cupric oxide coated fuser roll of this invention. A presently preferred starting fuser roll assembly has a metallic circumferential surface that is adapted to provide a smooth and uniform substrate for a ceramic cupric oxide coating. Such a substrate is desirable for toner contacting as the fuser roll surface moves over the toner powder during fusion. Sometimes, the outer circumferential sleeve of a fuser roll assembly may be disassembled from the other fuser roll assembly components, and may be separately processed to produce a coated fuser roll circumferential surface in accordance with the present invention. For example, a fuser roll assembly can be employed such as described in U.S. Pat. No. 4,266,115 which employs an outer sleeve member 38.

To prepare a uniform ceramic cupric oxide coating or layer on outer circumferential surfaces portions of a fuser roll, the following procedure is preferred:

A solution of a copper carboxylate in a volatile (or an evaporatable) solvent is preliminarily prepared. While any soluble copper carboxylate can be employed, it is presently preferred to employ a cupric carboxylate characterized by the formula:

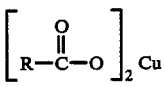

(1)

wherein

R is an alkyl radical.

The term "alkyl" as used herein refers to an alkyl radical that contains less than thirty carbon atoms. Straight, branched chain or cyclic alkyl radicals may be used.

Factors influencing the specific choice of the carboxylate include solubility in common solvents and stability against crystallization upon drying. Crystallization would result in film nonuniformity. Generally, higher solubility in common organic solvents and lower tendency toward crystallization upon drying are achieved when there are at least three carbon atoms in the R group. Branching in the R group is also effective in reducing spatial symmetry with a resulting lower tendency toward crystallization. For R groups containing many carbon atoms, the ultimate copper concentration in the solution is reduced. Thus, the preferred organic ligands contain from four to thirty carbon atoms, preferably from about six to about twenty carbon atoms.

A presently preferred cupric carboxylate is cupric 2-ethylhexanoate, which is commercially available.

Cupric 2-ethylhexanoate and other useful carboxylates are easily prepared by an acid-base reaction of CuO or copper carbonate with the appropriate carboxylic acid or by metathesis reaction of cupric acetate monohydrate with the carboxylic acid. In each case, an excess of the carboxylic acid can be used to prepare a solution of the desired carboxylate in the excess acid. Thus a Cu containing solution with a known Cu concentration can be prepared without the necessity of isolating the Cu carboxylate product.

The solvent for the treating solution can be chosen from a large variety of volatilizable liquids. The solvent is chosen for its ability to dissolve the Cu carboxylate, its viscosity and its ability to achieve a coating of the substrate. Useful solvents include straight chain, branched chain or cyclic hydrocarbons or mixtures thereof, carboxylic acids, esters, ketones, alcohols and terpenes. Exemplary preferred solvents include toluene, mineral spirits, 2-ethylhexanoic acid, butyl acetate and pinene.

The treating solution can also contain certain film promoting agents. These can include surfactants to assist in the wetting of the substrate. They can also include viscosity controlling agents. The film promoting agent can also be beneficial in inhibiting crystallization of the metal carboxylate upon drying of the film. Exemplary preferred film promoting agents include 2-ethylhexanoic acid, rosin (e.g. abietic acid), cyclohexanebutyric acid and ethyl lactate.

The concentration of cupric ions in a treating solution is generally in the range of about 2 to about 10 percent by weight and preferably about 4 to about 8 percent by weight.

The cupric carboxylate solution is distributed on and around the circumferentially opposed inner surfaces of an annulus or ring structure whose internal diameter is slightly larger than the outside diameter of the cylindrical surface of the fuser roll. The gap between such respective diameters provides a meniscus-type region which influences the thickness of a coating of the cupric carboxylate solution deposited on the cylindrical surface during coating. The roll cylindrical surface is then moved vertically upwardly through the ring as shown in FIG. 1 or alternatively, the ring is moved downwardly relative to the cylinder. The relative speed of passage of the roll through the ring and the viscosity of the treating solution also affect the coated solution thickness on the treated surface. The solution viscosity is influenced by the concentration of cupric carboxylate in the treating solution.

The actual type and structure of the ring coating apparatus in the region of the cylinder itself can vary widely, and a variety of ring coating systems are known in the art.

For example, referring to FIG. 1, there is illustrated a representative embodiment of a ring coating apparatus that is designated in its entirety by the numeral 10. Ring coating apparatus 10 includes a coating liquid supply reservoir 11, a coating ring 12, a simple chamber wall defining sleeve 13 that is detachably associated with the coating ring 12, and a delivery conduit 14 functionally interconnecting reservoir 11 with a coating solution sump or reservoir chamber 15. Interior side walls of chamber 15 are defined by a portion of the upper surface of ring 12, an interior circumferentially extending generally vertically disposed sidewall portion of sleeve 13, and adjacent portions of the circumferential surface region 16 of fuser roll 17. As roll 17 is moved upwardly (see arrow) relative to the spatial position of ring 12 and sleeve 13, portions of circumferential surface region 16 are coated with a layer 18 of cupric carboxylate treating solution from sump 15.

After being coated, the roll 17 is dried, conveniently in air at ambient temperatures with the circumferential surface region 16 vertically oriented, to remove solvent, and, thereafter, the circumferential surface region 16 and associated portions and components thereof are heated at a temperature in the range of about 350 to about 700° C. for a time sufficient to convert the cupric carboxylate to ceramic cupric oxide. The thermal decomposition of the copper carboxylate can be achieved in only minutes at the temperatures in the above range. However, because fusing rolls exhibit large thermal mass, it will require time for the coated film to reach its decomposition temperature. Typically, such times are in the range of about 0.5 to about 2 hours at the preferred temperatures indicated above.

The ring coating procedure is preferably carried out so that after drying and thermal conversion, the coating 18 on surface 16 is converted to a cupric oxide layer whose thickness is in the range of about 0.05 to about 1 micron in radial thickness, and preferably about 0.1 to about 0.5 microns. Thicker cupric oxide layer thickness can be achieved by repeated applications of the treating solution following thermal conversion.

Thereafter, the resulting coated surface 16 is overcoated with a mercapto-group containing silicone material, such as, for example, a thio-functional polysiloxane polymer that is described in U.S. Pat. Nos. 4,046,795; 4,101,686; 4,029,827; or the like. The term "thio-functional" as used herein is equivalent to the term "mercapto-group containing" or "mercaptogroup".

Such an overcoating can be applied by any convenient procedure, including ring coating, if desired, or alternatively, brushing, wiping, dipping, or the like.

The thio-functional siloxane material reacts on contact with the ceramic cupric oxide layer to produce a permanently lubricated surface layer over the ceramic cupric oxide layer which acts as a release film for non-reactive thermoplastic resin toners brought into contact therewith at the temperatures normally used for heat fusing toner powders. These temperatures generally are in the range of about 25 to about 200° C. Excess, unreacted quantities of applied thio-functional polysiloxane on the ceramic cupric oxide surface may be removed by wiping, or the like. The thickness of the lubricating surface layer on fuser roll 17 is estimated to be in the range of about 10 to about 1000 Angstroms measured radially (i.e., perpendicularly to the cylindrical surface 16).

The ceramic cupric oxide appears to be highly selective in its reactivity with mercapto groups. For example, little or no reaction of the ceramic cupric oxide layer occurs with siloxanes containing other functional groups, such as hydroxy, amino, epoxy or isocyanate groups at ambient conditions.

Figure 3:
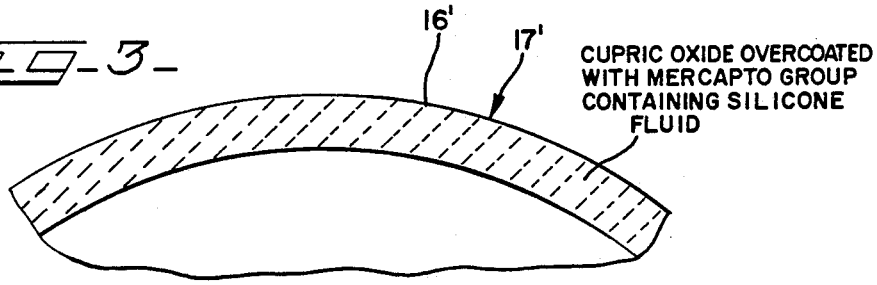
FIG. 3 is an enlarged fragmentary, vertical sectional view in the region 3 of FIG. 2 showing the surface structure of the fuser roll.

The appearance of the surface of a fuser roll of this invention is shown in FIG. 3.

The coated fuser roll has a hard, durable, cylindrical surface and displays a long service life when used in automatically operating electrophotographic copying machines.

Figure 2:
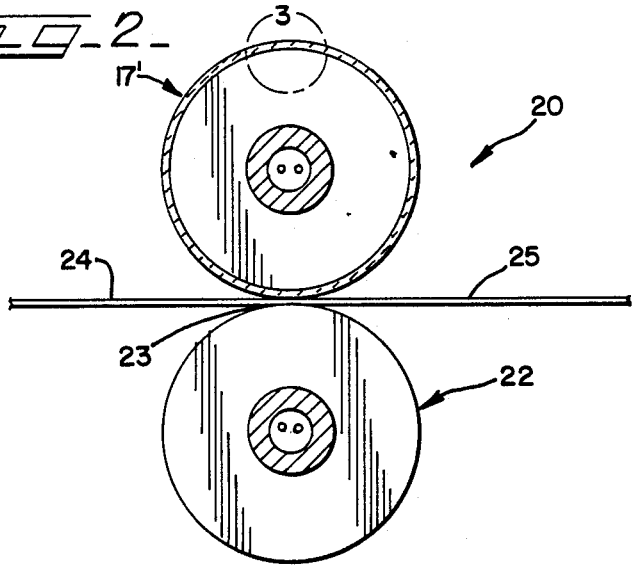
FIG. 2 is a vertical sectional view of a toner fusion process through a cooperating fuser roll of this invention and a pressure roll.

For illustrative purposes, reference is had to FIG. 2 which shows a diagrammatic vertical sectional view through an embodiment of a fuser assembly 20 incorporating a combination of a fuser roll 17' of the present invention (which is comparable to roll 17, but wherein the cupric carboxylate coating has been converted to a ceramic cupric oxide coating), and a backup (or pressure) roll 22. Fuser roll 17' and pressure roll 22 have spaced, generally parallel respective axes, and fuser roll 17' cooperates with pressure roll 22 to form a nip or contact area 23 through which a sheet 24 of copy paper passes. The sheet 24 is oriented so that a toned image (not shown) on the upper surface 25 of sheet 24 passes through nip 23, with surface 25 being in adjacent, contacting relationship to roll 17'. Both roll 17' and roll 22 are internally heated in a controlled manner so as to be at a predetermined temperature for achieving good fusion of toner powder deposited on surface 25.

Usually, pressure roll 22 has a rigid steel core and an elastomeric circumferential surface, although any convenient or operable pressure roll structure can be employed. In passing through the nip 23, the toner on sheet surface 25 is heat fused, but no toner powder adheres to the surface 16' of roll 17.

The invention further illustrated by the following examples.

Example 1: Fuser Roll Manufacture

A toner fuser roll having a stainless steel cylinder with a diameter of 3.25 inches, a length of 15 inches and a wall thickness of about 3/16 inch was used. A treating solution containing 5.7 weight percent copper was prepared by combining 2.0 g of cupric acetate monohydrate (Baker 1766-1) with 8.0 g of 2-ethylhexanoic acid. The resulting mixture was heated in an open vial at its boiling point for two minutes. During the heating a transcarboxylation occurred with at least a partial substitution of ligands on the copper ion, and liberation of acetic acid. After the two minute heating period, a blue solution was formed, there having remained no solids in the vial. To the above solution was added 2.0 g of rosin (Eastman 2315) which functions as a film promoting agent. The mixture was then heated until the rosin was completely incorporated. The so produced treating solution was found to have a copper concentration of 5.7% by weight as determined by thermal gravimetric analysis (TGA). Using a ring coating apparatus as illustrated in FIG. 1 and described herein, the circumferential surface of the fuser roll was coated with a uniform layer of solution by moving the fuser roll upwardly through the ring at a rate of about 1 inch per second. The freshly coated roll has a layer thickness of about 2 microns.

Thereafter, with the roll oriented in a vertical position, the solvent was evaporated from the coated surface in air at ambient temperatures. The resulting roll was then heated to 450° C. for 1 hour which converted the cupric 2-ethylhexanoate dry coating to ceramic cupric oxide (CuO). The final resulting coating has a thickness of about 0.5 microns.

The surface of the resulting coating was then overcoated by applying a thin layer with a paint brush of a mercapto-group containing silicone oil identified as F655 fluid obtained from Wacker Silicone Corp. The coating thus formed reacts with the ceramic copper oxide.

When the fuser roll was heated to a temperature of about 370° F., and toner powder was deposited on the oil treated roll, it was observed that toner powder did not adhere thereto. The roll is observed to have a hard surface.

Example 2: Fuser Roll Use

The fuser roll of Example 1 was utilized as the fuser roll in an Eastman Kodak copier machine (EKTAPRINT Model 250). The copier is charged with a yellow polyester toner similar to that used in a Coloredge color copier made by The Eastman Kodak Company.

The fuser roll and pressure roll surface temperatures in this copier are set for 370° F. which is a higher temperature than the recommended commercial operational temperature of about 330 to about 350° F. for such toner. This high temperature was selected to accelerate any toner adhesion (offset) to the fuser roll.

When the machine was operated at the approximate rate of 70 copies per minute using 8½" by 11" paper sheets, the fuser roll was observed to produce 1300 fused toner duplex copies before toner offset occurred.

This result, although it was obtained with a fuser roll coating structure that was not fully optimized, is considered to be excellent for a duplex process where toner is in direct contact with the hot fuser roll.

Example 3: Control

A fuser roll of similar structure and construction except that its exterior circumferential surfaces were comprised of uncoated anodized aluminum was mounted and utilized as the fuser roll in the same copier machine which was then operated under identical conditions.

This fuser roll was observed to make only 607 duplex copies before toner offset occurred.

The foregoing specification is intended as illustrative and is not to be taken as limiting. Still other variations within the spirit and the scope of the invention are possible and will readily present themselves to those skilled in the art.

I claim:

1. In a fuser roll of the class adapted for fusing thermoplastic resin toner powder images to a substrate sheet at elevated temperatures and having outer circumferential surface portions, the improvement which comprises a coating over said circumferential surface portions consisting essentially of ceramic cupric oxide, said coating being overcoated with a chemically bound layer of a mercapto group containing silicone fluid.

2. The roll of claim 1 wherein said coating has a thickness of about 0.05 to about 1 micron.

3. The roll of claim 1 wherein said layer has a thickness of about 10 to about 1000 Angstroms.

4. A fuser roll for fusing thermoplastic resin powder images to a substrate sheet comprising:

electric heating means disposed for uniform heating of circumferential surface portions of said roll, core means for supporting and positioning said heating means, thermally conductive material covering outer exposed surfaces of said heating means, sleeve means positioned circumferentially around said thermally conductive material, said sleeve means having an adherent coating over the outer surfaces thereof, said coating consisting essentially of ceramic cupric oxide, and a chemically bound layer of a mercapto group containing silicone polymer over said coating.

5. The roll of claim 4 wherein said coating has a thickness of about 0.05 to about 1 micron.

6. The roll of claim 4 wherein said layer has a thickness of about 10 to about 1000 Angstroms.

7. A method of fusing a toner image to a substrate comprising the steps of:

(a) forming a coating consisting essentially of ceramic cupric oxide over circumferential surface portions of a fuser roll;

(b) overcoating said coating with a chemically bound layer of a mercapto group containing silicone polymer; and (c) passing the overcoated fuser roll upon and over said toner image on the substrate with said fuser roll being heated to a fusion temperature for said toner powder.

* * * * *